US010256067B1

(12) United States Patent
Sommerer et al.

(10) Patent No.: US 10,256,067 B1
(45) Date of Patent: Apr. 9, 2019

(54) LOW VOLTAGE DROP, CROSS-FIELD, GAS SWITCH AND METHOD OF OPERATION

(71) Applicants: General Electric Company, Schenectady, NY (US); Wisconsin Alumni Research Foundation, Madison, WI (US)

(72) Inventors: Timothy John Sommerer, Ballston Spa, NY (US); David John Smith, Clifton Park, NY (US); Joseph Darryl Michael, Delmar, NY (US); Steven Charles Aceto, Wynantskill, NY (US); Kirk Ernest Marquard, Burlington, CT (US); Jason Fredrick Trotter, Glenville, NY (US); James E. Lawler, Madison, WI (US); William Nicholas Guy Hitchon, Verona, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/860,225

(22) Filed: Jan. 2, 2018

(51) Int. Cl.
*H01J 17/14* (2006.01)
*H01J 17/44* (2006.01)
*H01J 17/64* (2006.01)

(52) U.S. Cl.
CPC ..... *H01J 17/14* (2013.01); *H01J 17/44* (2013.01); *H01J 17/64* (2013.01)

(58) Field of Classification Search
None
See application file for complete search history.

(56) References Cited

U.S. PATENT DOCUMENTS

| | | | |
|---|---|---|---|
| 3,638,061 | A | 1/1972 | Lutz et al. |
| 4,596,945 | A | 6/1986 | Schumacher et al. |
| 5,008,798 | A | 4/1991 | Harvey et al. |
| 5,019,752 | A | 5/1991 | Schumacher |
| 5,075,594 | A | 12/1991 | Schumacher et al. |

(Continued)

FOREIGN PATENT DOCUMENTS

| | | | |
|---|---|---|---|
| CN | 102176401 | B | 4/2013 |
| JP | 2012224886 | A | 3/2015 |
| WO | 2014142974 | A1 | 9/2014 |

OTHER PUBLICATIONS

Goebel, Dan M. "Cold-cathode, pulsed-power plasma discharge switch." Review of scientific instruments 67, No. 9 (1996): 3136-3148.

(Continued)

*Primary Examiner* — Dion Ferguson
*Assistant Examiner* — Srinivas Sathiraju
(74) *Attorney, Agent, or Firm* — GE Global Patent Operation; Nitin N. Joshi

(57) ABSTRACT

A gas switch includes an anode and a cathode spaced apart from the anode, wherein the cathode includes a conduction surface. The gas switch also includes a plurality of magnets arranged to generate a magnetic field that defines an annular path over a portion of the conduction surface at a radial distance from a switch axis, and a control grid positioned between the anode and the cathode. In operation, the control grid is arranged to establish a conducting plasma between the anode and the cathode, wherein, in the presence of the conducting plasma, a voltage drop between the anode and the cathode is less than 150 volts, and wherein the conducting plasma forms a cathode spot that circles the annular path.

19 Claims, 5 Drawing Sheets

(56) References Cited

U.S. PATENT DOCUMENTS

| | | | |
|---|---|---|---|
| 5,132,597 | A | 7/1992 | Goebel et al. |
| 5,329,205 | A | 7/1994 | Goebel et al. |
| 5,568,019 | A | 10/1996 | Mason et al. |
| 5,631,524 | A | 5/1997 | Matsuzaki et al. |
| 5,828,176 | A | 10/1998 | Goebel |
| 6,433,480 | B1 | 8/2002 | Stark et al. |
| 6,787,010 | B2 | 9/2004 | Cuomo et al. |
| 7,825,595 | B2 | 11/2010 | Bochkov et al. |
| 8,685,213 | B2 | 4/2014 | Kouznetsov et al. |
| 9,520,801 | B1 | 12/2016 | She et al. |
| 2015/0098259 | A1 | 4/2015 | Michael et al. |
| 2016/0020057 | A1 | 1/2016 | Sommerer et al. |

OTHER PUBLICATIONS

Goebel, Dan M., R. L. Poeschel, and R. W. Schumacher. "Low voltage drop plasma switch for inverter and modulator applications." Review of scientific instruments 64, No. 8 (1993): 2312-2319.

Guseva, L. G. "On discharge striking in polyatomic gases at pd<(pd) min." In Investigations into Electrical Discharges in Gases, pp. 1-11. 1964.

Goerz, David A., Michael J. Wilson, and Ronnie D. Speer. "A low-profile high-voltage compact gas switch." In Pulsed Power Conference, 1997. Digest of Technical Papers. 1997 11th IEEE International, vol. 1, pp. 328-333. IEEE, 1997.

Goebel, D., "High Power Modulator for Plasma Ion Implantation", Journal of Vacuum Science & Technology B, Nanotechnology and Microelectronics: Materials, Processing, Measurement, and Phenomena, http://avs.scitation.org/doi/abs/10.1116/1.587356, vol. 12, Issue 02, Jun. 1998.

An-Jen et al., "Nano-ZnO Cold Cathodes for Controlling Plasma Switches", Nanotechnology, http://ieeexplore.ieee.org/document/1500809/, Sep. 6, 2005.

Li et al., "Finite element modeling of plasma initiation by carbon nanotubes (CNTs) as cold cathode in pseudospark switch Sign In or Purchase", Power Modulator and High Voltage Conference, http://ieeexplore.ieee.org/document/7287278/, Oct. 5, 2015.

Schonhuber, Max J. "Breakdown of gases below Paschen minimum: basic design data of high-voltage equipment." IEEE Transactions on Power apparatus and Systems 2 (1969): 100-107.

LOW VOLTAGE DROP, CROSS-FIELD, GAS SWITCH AND METHOD OF OPERATION

STATEMENT REGARDING FEDERALLY SPONSORED RESEARCH AND DEVELOPMENT

This invention was made with Government support under contract number DE-AR0000298 awarded by the Department of Energy Advanced Research Projects Agency-Energy. The Government has certain rights in this invention.

BACKGROUND

The field of disclosure relates generally to a low voltage drop, cross-field, gas switch and, more particularly, to a cross-field, gas switch that experiences a low forward voltage drop between an anode and cathode of the gas switch during operation thereof.

Cross-field gas switches, such as planar cross-field gas switches, are known. Conventionally, these switches include an electrode assembly, such as a cathode spaced apart from an anode, enclosed by a gas-tight chamber. The gas-tight chamber is filled with an ionizable gas, and a voltage is applied to a control grid disposed between the anode and cathode to initiate a plasma path therebetween. The switch is operable, in the presence of an input voltage applied to the anode, to conduct a large electrical current between the anode and the cathode. The plasma path may be terminated by reverse biasing the control grid, such that the electrical current flowing from the anode to the cathode is drawn off by the control grid (and accompanying circuitry). Thus, the device functions as a gas filled switch, or "gas switch" in the presence of an input voltage and a conducting plasma.

Drawbacks associated with at least some known switches include a large forward voltage drop between the anode and the cathode during conduction. Specifically, many common gas switches experience a voltage drop of several hundred volts in the gap between the anode and the cathode. The large majority of this voltage drop is experienced at or near a conduction surface of the cathode, resulting, in most cases, in thermal losses and ablation or "sputtering" of the cathode conduction surface. Sputtering tends to reduce the useful life of the gas switch, such as, for example, to a matter of hours or days in a conduction mode. Thus, conventional gas switches tend not to be feasible for large-scale, long-term, implementation in power systems where reliability, cost, and lifecycle are important considerations.

A cross-field gas switch that experiences a low forward voltage drop between an anode and cathode of the gas switch during operation is therefore desirable, particularly, where the forward voltage drop between the anode and the cathode is sufficiently low to prolong the lifespan of the device to many years, rather than, as described above, several hours or months. A gas switch that does not generate large quantities of excess thermal heat, and which does not require large heat sinking equipment, is also desirable.

BRIEF DESCRIPTION

In one aspect, a gas switch arranged about a switch axis is provided. The gas switch includes an anode and a cathode spaced apart from the anode, wherein the cathode includes a conduction surface. The gas switch also includes a plurality of magnets arranged to generate a magnetic field, a portion of which extends substantially parallel to a portion of the conduction surface at a radial distance from the switch axis, wherein the magnetic field defines a closed annular path over the portion of the conduction surface at the radial distance. The gas switch also includes a first grid positioned between the cathode and the anode, wherein the first grid defines a grid-to-cathode gap that contains an ionizable gas. In addition, the gas switch includes a second grid positioned between the first grid and the anode, wherein the second grid defines a grid-to-anode gap. In operation, the second grid is arranged to receive a bias voltage to establish a conducting plasma between the anode and the cathode, wherein, in the presence of the conducting plasma, a voltage drop between the anode and the cathode is less than 150 volts and wherein the conducting plasma forms a cathode spot that circles the annular path.

In another aspect, a gas switch arranged about a switch axis is provided. The gas switch includes an anode and a cathode spaced apart from the anode, wherein the cathode includes a conduction surface. The gas switch also includes a plurality of magnets arranged to generate a magnetic field that defines an annular path over a portion of the conduction surface at a radial distance from the switch axis, and a control grid positioned between the anode and the cathode. In operation, the control grid is arranged to establish a conducting plasma between the anode and the cathode, wherein, in the presence of the conducting plasma, a voltage drop between the anode and the cathode is less than 150 volts, and wherein the conducting plasma forms a cathode spot that circles the annular path at a frequency greater than 0.1 kilohertz.

In yet another aspect, a method for operating a gas switch is provided. The method includes establishing a conducting plasma between an anode and a cathode spaced apart from the anode, and establishing a magnetic field, at least a portion of which extends substantially parallel to a portion of a conduction surface of the cathode, wherein the magnetic field defines an annular path over the portion of the conduction surface. The method also includes applying a pulsed input voltage to a control grid disposed between the anode and the cathode, wherein, in response to the application of the pulsed input voltage, a voltage drop between the anode and the cathode is less than 150 volts, and wherein the conducting plasma forms a cathode spot that circles the annular path.

DRAWINGS

These and other features, aspects, and advantages of the present disclosure will become better understood when the following detailed description is read with reference to the accompanying drawings in which like characters represent like parts throughout the drawings, wherein.

Figure 1:
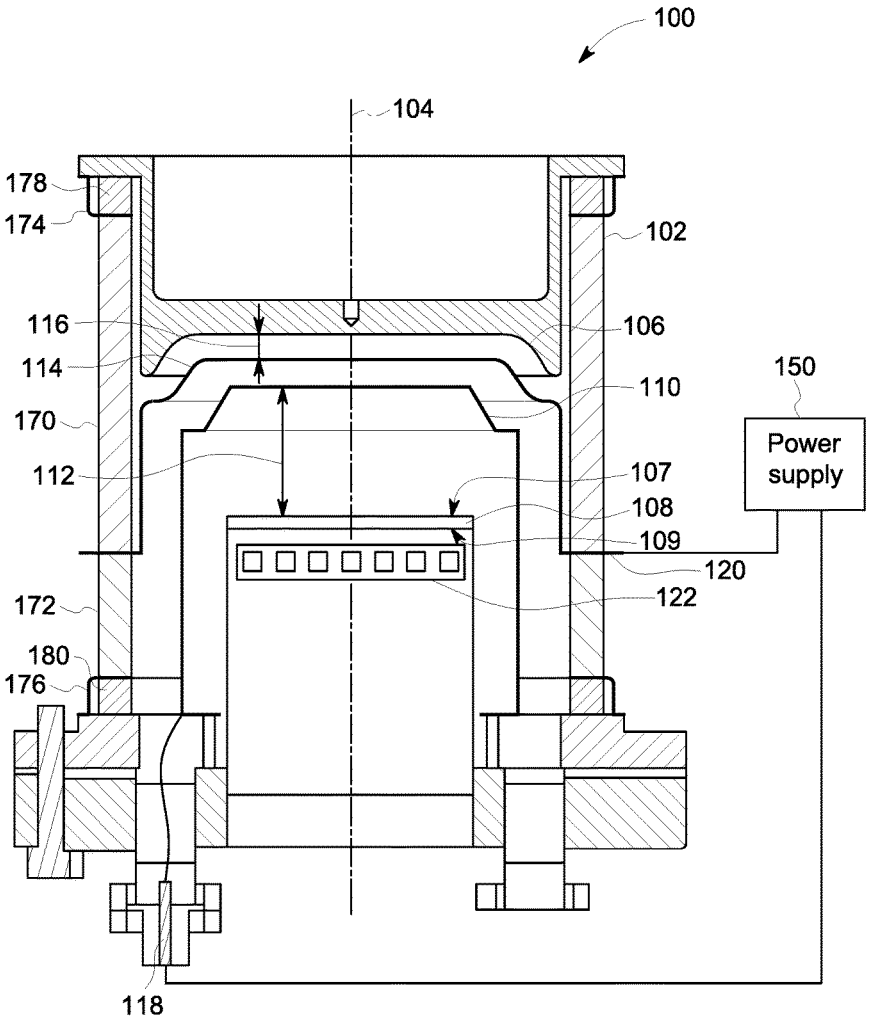
FIG. 1 is a cross-sectional view of an exemplary low voltage drop, planar, cross-field, gas switch.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As used herein, spatially relative terms, such as "beneath," "below," "under," "lower," "higher," "above," "over," and the like, may be used to describe one element or feature's relationship to one or more other elements or features as illustrated in the figures. It will be understood that such spatially relative terms are intended to encompass different orientations of the elements and features described herein both in operation as well as in addition to the orientations depicted in the figures. For example, if an element or feature in the figures is turned over, elements described as being "below" one or more other elements or features may be regarded as being "above" those elements or features. Thus, exemplary terms such as "below," "under," or "beneath" may encompass both an orientation of above and below, depending, for example, upon a relative orientation between such elements or features and one or more other elements or features.

As used herein, the term "cathode spot" refers to a visual appearance of a bright, rotating spot at a conduction surface of a cathode. The cathode spot appears within the gas switch, as described herein, during conduction. In addition, the cathode spot may be observed using a high-speed camera, such as a high speed digital camera and/or a high speed charge-coupled device camera (or "CCD" camera). More particularly, and as described below, a visual appearance of the conducting plasma includes a diffuse glow of conducting plasma adjacent to an anode, a bright, rotating cathode spot at a conduction surface of a cathode, and transition region of conducting plasma between the cathode spot and the anode.

Embodiments of the present disclosure relate to a gas switch that operates in low forward voltage drop mode. In this mode, sputtering over a conduction surface of a cathode is substantially reduced, and waste heat generated by operation of the gas switch is also reduced. Specifically, the gas switch operates at a low forward voltage drop in the range of 50-150 volts. To maintain a low forward voltage drop, conducting plasma is established between an anode and a cathode and constrained, in part, to an area of concentrated current (or "cathode spot"). The cathode spot is induced into circular motion over an annular path on the surface of the conduction surface, such that no single area of the conduction surface is strongly heated, leading to ablation or evaporation, thereby substantially increasing the lifespan of the gas switch. In addition, an ion energy of the conducting plasma is reduced when the forward voltage drop is low, resulting in reduced sputtering at the conduction surface of the cathode.

FIG. 1 is a cross-sectional view of an exemplary low voltage drop cross-field, gas switch 100 (or "gas switch"). Gas switch 100 is generally cylindrical and includes a cylindrical gas-tight housing 102 that encloses and seals the various switch components described herein. A switch axis 104 extends through and is defined with respect to gas-tight housing 102. In the exemplary embodiment, gas-tight housing 102 includes an insulating material, such as a ceramic insulator. Further, as described below, a conductive ring 120 may be inserted and/or sealed between upper and lower portions of gas-tight housing 102 without affecting the gas-tightness and/or insulating properties of gas-tight housing 102.

For example, in some embodiments, gas-tight housing 102 comprises an upper cylindrical portion 170 and a lower cylindrical portion 172, where upper cylindrical portion 170 and lower cylindrical portion 172 are separated by and mechanically coupled through conductive ring 120. Thus, in at least some embodiments, gas-tight housing 102 is made up of upper cylindrical portion 170 and lower cylindrical portion 172 with conductive ring 120 sandwiched therebetween. In addition, in some embodiments, gas-tight housing 102 may include an upper metal ring 174 that is welded or otherwise electrically and mechanically coupled to an anode (as described below) and a lower metal ring 176 that is welded or otherwise electrically and mechanically coupled to a cathode (as described below). Further, in some embodiments, upper metal ring 174 may be surrounded by an upper mounting ring 178, and lower metal ring 176 may be surrounded by a lower mounting ring 180, each of which may facilitate a gas tight seal on gas-tight housing 102.

Figure 5:
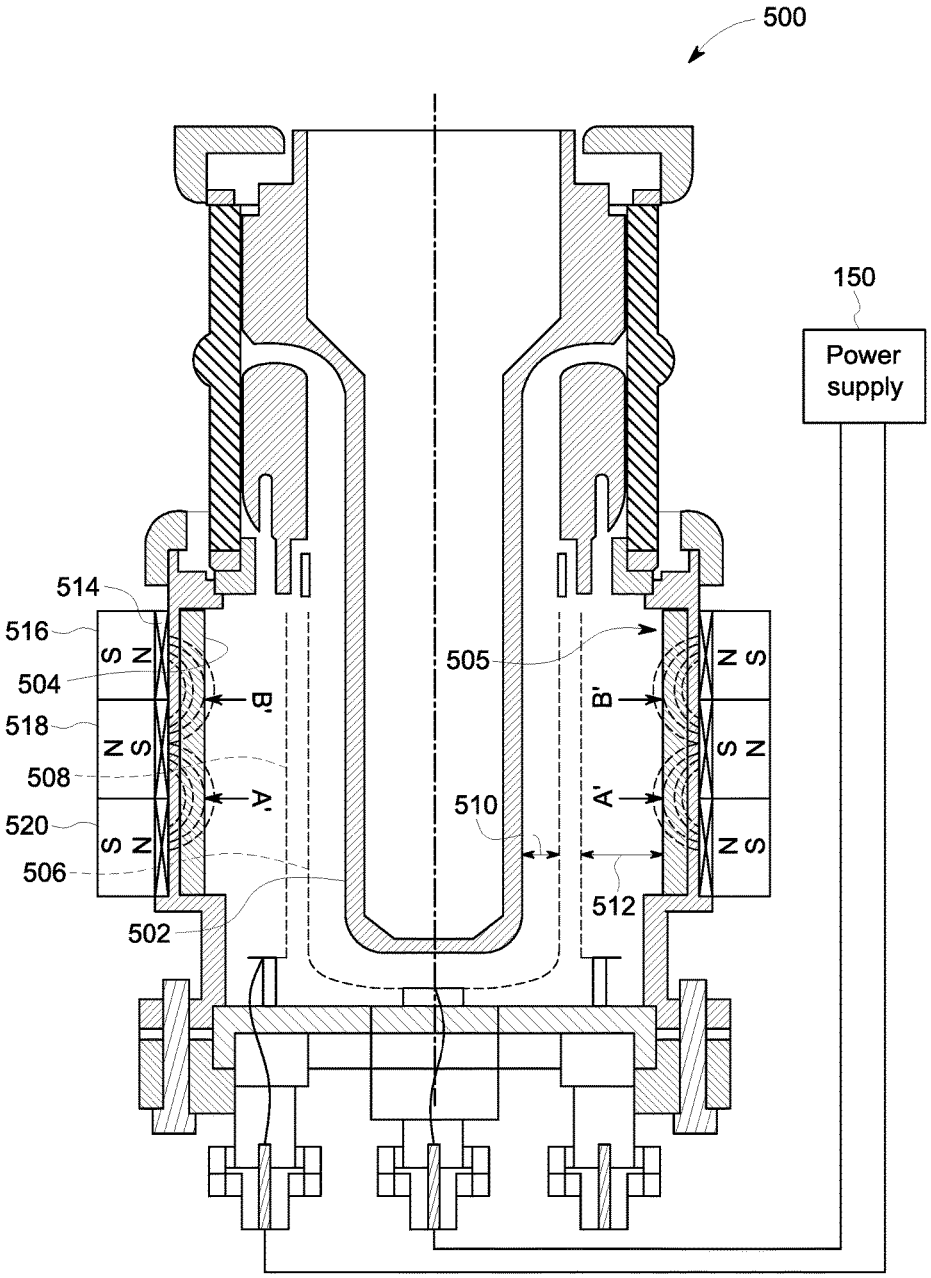
FIG. 5 is a cross-sectional view of an exemplary low voltage drop, cylindrical, cross-field, gas switch.

In the exemplary embodiment, gas switch 100 also includes a planar anode 106 and a substantially planar cathode 108. Cathode 108 is axially separated (or spaced apart) from anode 106 and disposed in substantially parallel relationship to anode 106. Cathode 108 includes an upper surface, such as a conduction surface 107, and a lower surface 109. As described herein, cathode 108 need not, in all embodiments, be completely planar. For example, in some embodiments, cathode 108 includes an undulating or corrugated conduction surface 107. In other embodiments, however, conduction surface 107 is a smooth, planar, surface. Another embodiment of gas switch 100 substitutes a concentrically arranged anode-cathode pair for the planar anode and cathode depicted at FIG. 1. Such an embodiment is shown at FIG. 5 and described in greater detail below.

With continuing reference now to FIG. 1, a keep-alive grid 110 ("KA grid" or "first grid") is positioned between cathode 108 and anode 106 and defines a grid-to-cathode gap 112, which may be filled with an ionizable gas with low atomic mass, such as helium gas, hydrogen gas, or mixtures of hydrogen and helium, such as to a gas pressure in the range of 0.01-1.0 torr. For example, grid-to-cathode gap 112 may be filled from a gas storage reservoir (not shown). In various embodiments, there is only one interior gas volume within gas-tight housing 102, such that gas in grid-to-cathode gap 112 is in full communication with gas in a grid-to-anode gap 116 (described below). In the exemplary embodiment, KA grid 110 is a substantially planar, electrically conductive, perforated structure. Specifically, KA grid 110 includes a plurality of perforations, apertures, or holes, sized to permit the flow of ionized gas (e.g., plasma) and electrons therethrough.

A control grid 114 (or "second grid") is also included in gas switch 100. Specifically, control grid 114 is positioned between KA grid 110 and anode 106 and defines a grid-to-anode gap 116 (or "high voltage gap"). Like KA grid 110, control grid 114 is a substantially planar, electrically conductive, perforated structure. Specifically, control grid 114 includes a plurality of perforations, apertures, or holes, sized to permit the flow of ionized gas (e.g., plasma) and electrons therethrough. As described herein, cathode 108 need not, in all embodiments, be totally planar. However, in at least some embodiments, anode 106 includes a planar surface opposed to control grid 114. In some embodiments, control grid 114 may be excluded from gas switch 100, in which case, gas switch 100 may function as a diode that is forward biased by a fast rising voltage and/or current pulse applied to anode 106.

A wire lead 118 extends through gas-tight housing 102 and is electrically and mechanically connected between KA grid 110 and a bias voltage supply 150 (or "power supply") arranged to provide a bias voltage to KA grid 110. Similarly, conductive ring 120 is mounted within gas-tight housing 102 (e.g., as described above) and is electrically and mechanically connected between control grid 114 and bias voltage supply 150, such that conductive ring 120 is arranged to provide a bias voltage to control grid 114. More particularly, and as described herein, conductive ring 120 may provide a reverse bias voltage to control grid 114 to "open" gas switch 100, and a forward bias voltage, such as a rapidly rising forward bias voltage, to control grid 114, to "close" gas switch 100.

A system of magnets 122 is also implemented in gas switch 100. Specifically, in the exemplary embodiment, a system of magnets is disposed in close proximity to cathode 108, such as, for example, under or below cathode 108. In some embodiments, system of magnets 122 is disposed in direct physical contact with lower surface 109 of cathode 108. In other embodiments, system of magnets 122 does not make direct physical contact with lower surface 109 but is disposed proximal to cathode 108, such that a magnetic field generated by system of magnets 122 extends through, about, and/or over cathode 108.

Figure 2:
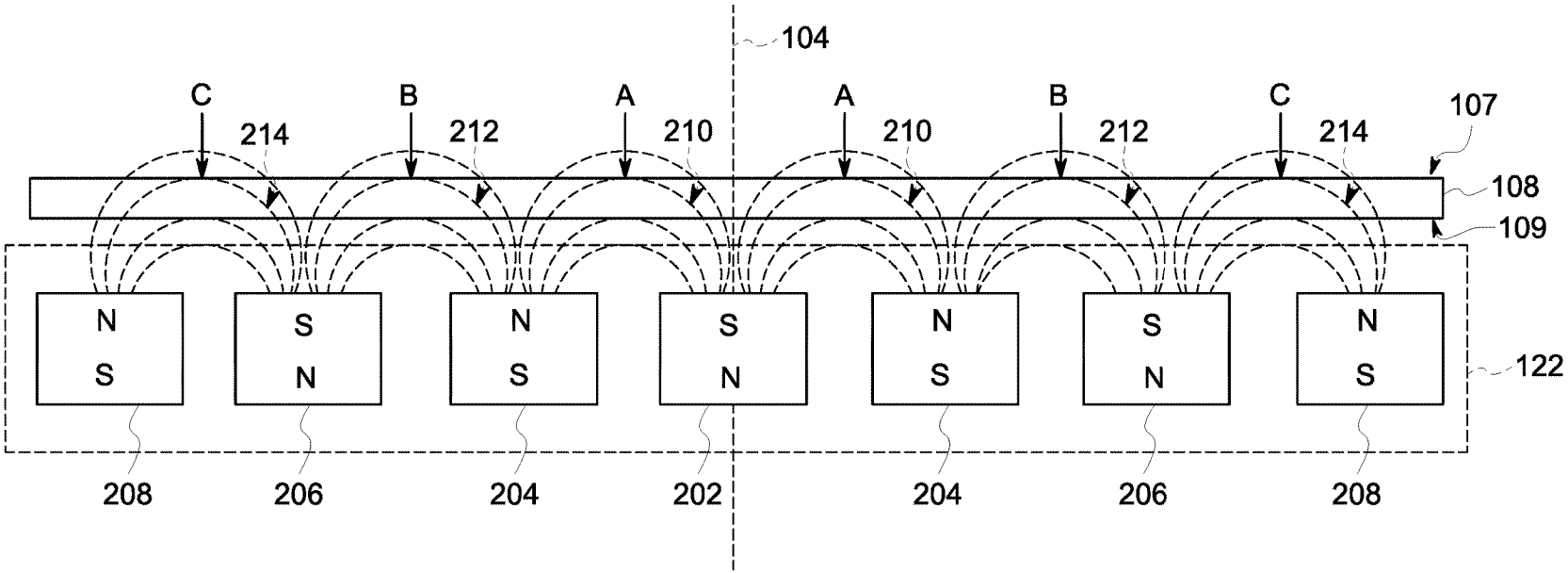
FIG. 2 is a cross-sectional view of an exemplary system of magnets that may be used with the gas switch shown at FIG. 1.

FIG. 2 is a cross-sectional view of system of magnets 122 (shown at FIG. 1). As shown, system of magnets 122 includes a plurality of magnets, such as a central magnet 202, a first ring magnet 204, a second ring magnet 206, and/or a third ring magnet 208. Although four magnets 202-208 are shown, in other embodiments, any suitable number of magnets may be incorporated in gas switch 100, such as, for example, to vary a number of closed annular conduction paths or "racetracks" (as described below) established on conduction surface 107 of cathode 108 and/or to vary the dimensions of one or more such racetracks.

In the exemplary embodiment, central magnet 202 is a pole magnet, such as, for example an elongated cylindrical magnet having a single north pole and a single south pole. Ring magnets 204-208 are ring-shaped or toroidal and are arranged concentrically around central magnet 202. Although ring magnets are described herein, in various embodiments, any closed magnet may be implemented, such as a closed square-shaped magnet, a closed rectangular magnet, a closed ovoid or oval-shaped magnet, and the like. In addition, the north and south poles of each ring magnet 204-208 are axially aligned with switch axis 104. In addition, pole and ring magnets 204-208 are alternatingly arranged, such as, for example, to achieve a north-south-north arrangement or a south-north-south arrangement. A north-south-north arrangement is shown at FIG. 2.

In operation, system of magnets 122 generates a magnetic field, such as, for example, a magnetic field extending between the alternatingly arranged north and south poles of magnets 202-208. More particularly, and as shown, a first group of magnetic field lines 210 may extend between central magnet 202 and first ring magnet 204. Likewise, a second group of magnetic field lines 212 may extend between first ring magnet 204 and second ring magnet 206, and a third group of magnetic field lines 214 may extend between second ring magnet 206 and third ring magnet 208.

In addition, each group of magnetic field lines 210-214 may pass under, over, and/or through cathode 108. Further, in some areas, the magnetic field lines generated by magnets 202-208 may extend substantially parallel to (or tangentially to) conduction surface 107 of cathode 108. For example, and as shown, first group of magnetic field lines 210 extends substantially parallel to conduction surface 107 over a first region, "A." Similarly, second group of magnetic field lines 212 extends substantially parallel to conduction surface 107 over a second region, "B," and third group of magnetic field lines 214 extends substantially parallel to conduction surface 107 over a third region, "C."

The function of regions A, B, and C in gas switch 100 are described in greater detail below. However, the operation of gas switch 100 is next described to facilitate a greater understanding of the role played, within gas switch 100, by these regions.

Accordingly, and with returning reference to FIG. 1, to initiate operation of gas switch 100, a bias voltage is provided to KA grid 110, such as via wire lead 118, and a reverse bias voltage is applied to control grid 114, such as via conductive ring 120. This bias voltage applied to KA grid 110 energizes KA grid 110, such as to a voltage sufficient to weakly ionize the gas maintained in grid-to-cathode gap 112, while the reverse bias voltage applied to control grid 114 prevents passage of the ionized gas beyond and/or through control grid 114. Thus, KA grid 110 is forward biased and control grid 114 is reverse biased to create (and maintain or "keep alive") a relatively weak plasma in grid-to-cathode gap 112. In this condition, plasma is confined to grid-to-cathode gap 112, and gas switch 100 is "open," in that electrical current is unable to flow from anode 106 to cathode 108.

In some embodiments, KA grid 110 is excluded from gas switch 100. In such a case, no relatively weak "keep alive" plasma is maintained in grid-to-cathode gap 112. Rather, an initial plasma may be created when a cosmic ray impinges on the ionizable gas within gas switch 100, creating an initial or "seed" ionization in the ionizable gas. The seed ionization is subsequently amplified by electron avalanching in the relatively high electric field developed within gas switch 100, leading to creation of a conducting plasma, as described below. However, to reduce the statistical uncertainty associated with reliance on an incident cosmic ray, KA grid 110 may be implemented in gas switch 100 to facilitate operation (e.g., turn on) of gas switch 100.

To "close" gas switch 100, a forward bias voltage is applied to control grid 114, such as via conductive ring 120, and a constant input voltage is applied at anode 106. Specifically, a forward bias voltage in the range of 0-3 kilovolts (relative to cathode 108) is applied to control grid 114, and anode 106 is charged to a voltage in the range of 10-1000 kilovolts. As control grid 114 is energized to this voltage, the relatively weak "keep alive" plasma confined in grid-to-cathode gap 112 becomes more highly ionized (and more conductive) and is electrically drawn through KA grid 110 towards control grid 114, and a conducting plasma (or a "plasma path") is established between control grid 114 and cathode 108. In addition, the voltage applied to anode 106 will draw the conducting plasma (through control grid 114) into electrical contact with anode 106, extending the plasma path and completing the circuit between anode 106 and cathode 108.

During conduction, a voltage drop (or "forward voltage drop") is observed between anode 106 and cathode 108. However, the voltage is not dropped uniformly in the space between anode 106 and cathode 108. Rather, almost all of the voltage is dropped within less than several millimeters of cathode 108 (and for the conditions within gas switch 100, often less than 1 millimeter), such that, if the forward voltage drop is too high (e.g., in the range of several hundred volts or greater), much of conduction surface 107 is rapidly "sputtered" off by impinging ions with energy corresponding to the forward voltage drop. If conduction surface 107 is sputtered in this manner, as is the case with many existing systems, the lifespan of gas switch 100 may be reduced to a matter of several hours or days of conduction-phase operation.

Accordingly, to reduce the forward voltage drop (and extend the lifespan of gas switch 100), gas switch 100 may be implemented, such that a "cathode spot" (as defined above) is created and maintained in a constant direction of travel (e.g., clockwise or counterclockwise) on an annular path over conduction surface 107. The annular path may be established, as described below, by the magnetic field generated by system of magnets 122. Further, as used herein, and for simplicity, the annular path over which the cathode spot travels may be referred to as a "racetrack."

In the exemplary embodiment, the rotation direction of such a cathode spot is in the $-E\times B$ direction, where B is the magnetic field (vector) imposed by system of magnets 122 over a "racetrack" (and points radially outward or inward, depending on the orientation of system of magnets 122), and where E is the electric field (vector) that is set up by the conducting plasma at conduction surface 107 of cathode 108, and always points into conduction surface 107. $-E\times B$ therefore points azimuthally around a particular racetrack. Hence, the notation "cross-field" (e.g., $E\times B$) is used herein to specify that the conducting plasma is influenced by, and rotates or "drifts," in a direction established by the interaction of the orthogonally arranged E and B fields. In addition, if there are multiple racetracks (as described herein), the cathode spot will move in the opposite direction along each successive racetrack.

Figure 3:
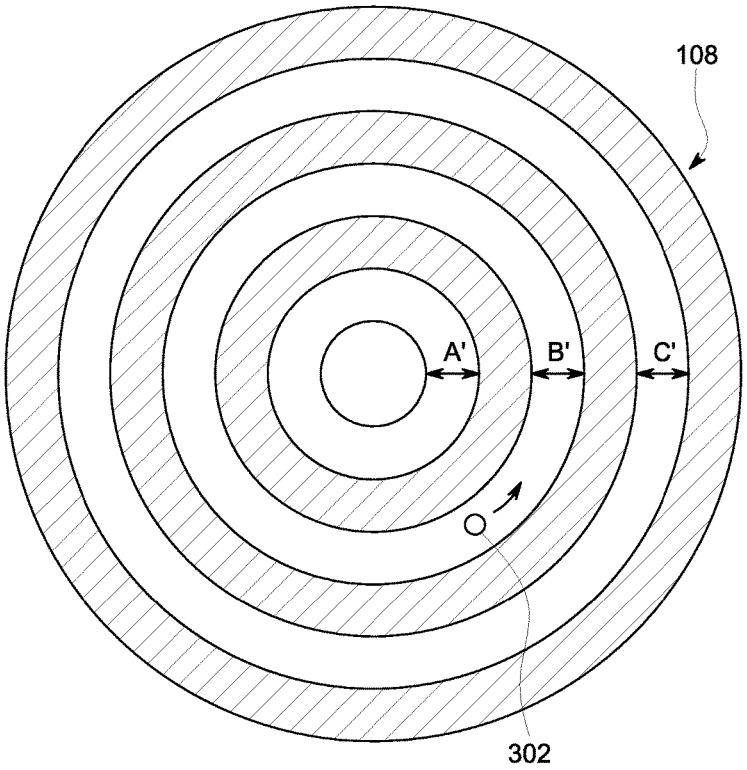
FIG. 3 is a top view of an exemplary cathode of the gas switch shown at FIG. 2, in which a plurality of annular paths over which a cathode spot may travel are shown.

Accordingly, with combined reference to FIG. 2 and FIG. 3, one or more racetracks may be established on conduction surface 107 by operation of system of magnets 122. For example, first region, A, may in fact correspond to a first racetrack A' on conduction surface 107. Likewise, second region, B, may correspond to a second racetrack B', and third region, C, may correspond to a third racetrack C'. In other words, a racetrack corresponds to a region on conduction surface 107 where the magnetic field lines produced by system of magnets 122 form a closed path and run parallel, or substantially parallel to, conduction surface 107. Further, in various embodiments, a width of a particular racetrack may be less than a physical separation between the magnets defining the racetrack.

As described above, a cathode spot, such as cathode spot 302, may be constrained to one of these racetracks A', B', or C', such that cathode spot 302 travels in a circular or circumferential path over the racetrack at a rate sufficient to limit ablation over the surface encompassed by the racetrack. Specifically, the magnetic field produced by system of magnets 122 may be sufficient, in conjunction with the electric field developed by conduction between anode 106 and cathode 108, to keep cathode spot 302 moving at a rate that limits localized heating (and subsequent ablation) of the racetrack. In some embodiments, the rotation rate is greater than approximately 0.1 kilohertz and less than approximately 100 kilohertz. In addition, in at least one embodiment, the rate of travel is in the range of 2-5 kilohertz, meaning, for example, that, cathode spot 302 may travel around (e.g., "circle" or "compass") a racetrack between 2,000 and 5,000 times per second. In the exemplary embodiment, cathode spot 302 may be maintained at a rate of travel around a racetrack A', B', or C' at a rate of approximately 3 kilohertz (or 3,000 revolutions per second).

Further, as described briefly above, creation of cathode spot 302 corresponds to a large reduction in the forward voltage drop experienced by gas switch 100. For example, in some embodiments, a forward voltage drop of less than 150 volts may be realized. In other embodiments, and under the conditions described below, a forward voltage drop of 80 volts has been achieved and reliably maintained. At this forward voltage drop, cathode sputtering is reduced to a level that increases the lifespan of gas switch 100 to at least several years. In addition, the waste heat produced by gas switch 100 at such a low forward voltage drop is greatly reduced. This, in turn, facilitates a reduction in the heat sinking equipment (not shown) that must be placed around gas switch 100 during operation within a working power system.

To create cathode spot 302, and to reduce the forward voltage drop, a combination of factors may be applied. Specifically, and in addition to the structure and implementation already described, a rapidly rising input voltage and/or current (e.g., a voltage and/or current pulse) may be applied to control grid 114. In the exemplary embodiment, a voltage in the range of 0-3 kilovolts discharged, through control grid 114, over a period of time less than 20 microseconds has verifiably resulted in generation of cathode spot 302. Similarly, a current pulse in the range of 4-12 amperes discharged, through control grid 114, over the same period of time is likewise sufficient. More broadly, the rate of voltage rise is in the range of 0.1-250 megavolts/second. For example, in some embodiments, the rate of voltage rise is approximately 1 megavolt/second.

Any suitable means of generating a voltage and/or current pulse may be implemented. For example, in some embodiments, a rapidly rising square wave may be provided to control grid 114, such as by bias voltage supply 150. Although the inventors do not wish to be bound by a specific physical explanation, it may be that rapid generation of a current pulse (at a sufficiently high voltage and/or current) results in a "pinch effect" within gas switch 100 (specifically, a "z-pinch'). In other words, as electrical current flows between anode 106 and cathode 108, the rapidly increasing current leads to a rapidly increasing magnetic field that is circumferential to the current flow and that is strong enough to "pinch" or constrain the radial extent of the plasma. Such pinched plasma may appear, to the naked eye, as cathode spot 302 on conduction surface 107 of cathode 108.

An additional physical explanation is that the low-voltage mode occurs when the gas in cathode spot 302 is only the filling gas (e.g., helium or hydrogen). More particularly, it may be that cathode spot 302 forms when the filling gas does not include metal vapor, such as, for example, metal vapor introduced as a result of cathode sputtering. Stated another way, it may be important to initiate high-current conduction quickly, such as, for example, to avoid an initial burst of sputtered metal atoms into the filling gas, which may, if it occurs, lead irreversibly to a higher voltage mode operation, or alternatively, to a damaging thermal-metal arc plasma. This physical explanation is based, at least in part, on the observation that hydrogen and helium have low atomic mass and large ionization energies (15 and 25 eV, respectively), compared with any heavy metal atom (typically 5 eV). Ions with high ionization potential are much more likely to release an electron when they strike cathode 108, and provide current, whereas metal ions with low ionization potential are less likely to release an electron, and conversely are heavy and more likely to sputter cathode 108.

Another important factor in the creation of cathode spot 302 is the selection of cathode material. In the exemplary embodiment, cathode 108 is manufactured from gallium, indium, tin, aluminum, and/or any alloy of these. In the case that gallium is selected, a cathode cup or reservoir (not shown) may be included in gas switch 100 to contain the gallium (e.g., because the melting point of gallium is near room temperature). Further, in the case of any of these materials, a strong oxide film can rapidly form over conduction surface 107, which may enhance electron emission by cathode 108 (e.g., as a result of the Malter effect), leading to lower forward-volt drop.

In addition, in the exemplary embodiment, cathode 108 is magnetized, such as to a magnetic field strength, measured at conduction surface 107, in the range of 100-2,000 gauss. Cathode 108 may also function as a "cold cathode," which, in the common usage of the term, means that the temperature of cathode 108 is less than 1500 Kelvin, but often less than 600 Kelvin. Cathode 108 may be cooled (e.g., liquid cooled and/or cryogenically cooled) to such a temperature; however, such secondary cooling is not required to maintain cathode 108 at a temperature less than 1500 Kelvin, and in some embodiments, cathode 108 may be at an ambient temperature.

Further, in the exemplary embodiment, it may be important that conduction surface 107 is substantially smooth and/or featureless. Specifically, imperfections, such as the placement of "intentional structure" (e.g., fasteners, screws, bolts, ridges, and other surface variations) may interfere with the continuous travel of cathode spot 302 on a racetrack. For example, if cathode spot 302 encounters a surface variation on conduction surface 107, the motion of cathode spot 302 may come to a temporary and/or permanent halt at the surface variation, which may result in undesirable sputtering at the surface variation.

Moreover, in at least some embodiments, there should be no nearby structure (e.g., "intentional structure," such as nearby conducting surfaces or conducting walls) capable of intercepting electrical current flowing to cathode 108. In addition, and as described briefly above, the selection of the ionizable gas provided within gas switch 100 may affect sputtering (and therefore lifespan). Specifically, in the exemplary embodiment, an ionizable gas with low atomic mass, such hydrogen and/or helium may be supplied. Low atomic-mass gases have low-atomic-mass ions that do not transfer high momentum to conduction surface 107, and as a result, reduce sputtering losses at conduction surface 107. Additionally, such low-atomic-mass gases have high ionization potential, which may increase the rate at which electrons are ejected from the cathode, leading to higher current at a given forward-volt drop.

Figure 4:
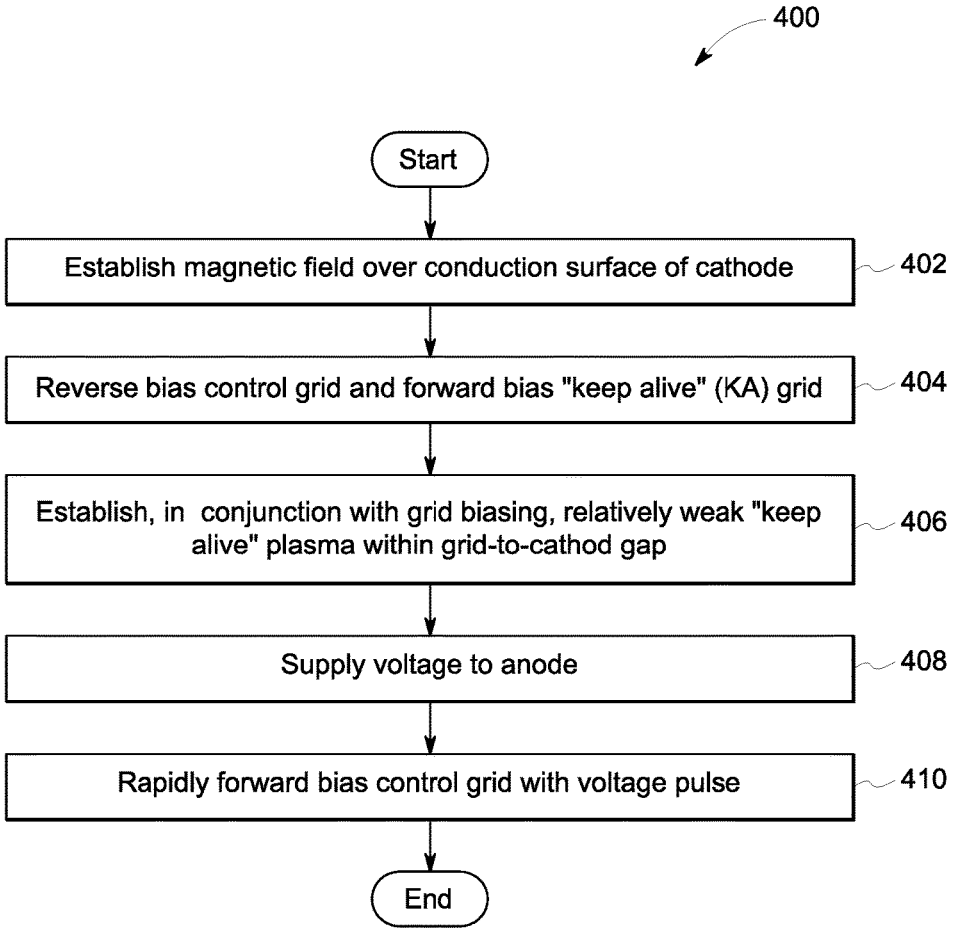
FIG. 4 is a flowchart illustrating an exemplary process of operating the gas switch shown at FIG. 1.

FIG. 4 is a flowchart illustrating an exemplary process 400 of operating gas switch 100 (shown at FIG. 1). In the exemplary embodiment, and as described in greater detail above, a magnetic field is established over conduction surface 107, at least a portion of which extends substantially parallel to a portion of a conduction surface 107 (step 402). As described above, the magnetic field defines an annular path (or "racetrack") over the portion of conduction surface 107.

Once the magnetic field is established at conduction surface 107, control grid 114 is reverse biased, and KA grid 110 is forward biased (step 404) (as described above) to establish a relatively weak "keep alive" plasma within grid-to-cathode gap 112 (step 406). In this configuration, gas switch 100 is "open" or non-conducting. To "close" gas switch, a large voltage (such as a voltage in the range of 10-1000 kilovolts) is provided on anode 106 (step 408), and a rapidly rising, or pulsed, input voltage (e.g., 0-3 kilovolts) is supplied to control grid 114 (step 410). In response to the application of the pulsed input voltage, a voltage drop between anode 106 and cathode 108 is less than 150 volts (e.g., 80 volts). In addition, cathode spot 302 is formed and guided, as described above, over a racetrack at a frequency in the range of 0.1-100 kilohertz.

With reference now to FIG. 5, a gas switch 500 that includes a concentrically arranged anode and cathode is shown. Specifically, gas switch 500 includes a cylindrical anode 502 and a cylindrical cathode 504 spaced apart from and arranged concentrically about anode 502. Gas switch 500 also includes a cylindrical control grid 506 and a cylindrical KA grid 508 spaced apart from and arranged concentrically about control grid 506. Control grid 506 and KA grid 508 are electrically conductive and include a plurality of apertures or perforations, as described above with respect to control grid 114 and KA grid 110. In addition, a grid-to-anode gap 510 is defined between control grid 506 and anode 502, and a grid-to-cathode gap 512 is defined between KA grid 508 and cathode 504. Grid-to-cathode gap 512 may be filled with an ionizable gas, as described above, and gas switch 500 may function generally as described above with respect to gas switch 100, except that electrical current flows in gas switch 500 radially, from anode 502 to cathode 504. Further, in various embodiments, anode 502 and control grid 506 may be spaced apart by a predefined distance, while a separation between cathode 504 and KA grid 508 may vary somewhat. For example, in some embodiments, a non-planar cathode 504 may be utilized, such as a cathode having an undulating or corrugated conduction surface.

A cylindrical system of magnets 514 may also be implemented in gas switch 500, such as, for example, concentrically about cathode 504. In the example shown at FIG. 5, system of magnets 514 includes a first ring magnet 516, a second ring magnet 518, and a third ring magnet 520. However, any suitable number of ring magnets may be applied to gas switch 500, such as, for example, and as described above, to produce any suitable number of racetracks on a conduction surface 505 of cathode 504. As described above, racetracks form where there is a closed path for E×B drift in a circumferential direction on conduction surface 505. In the example shown, two racetracks, A' and B', are created on conduction surface 505. Further, as described above with respect to gas switch 100, the orientations of magnets 516-520 may be alternated, such as, for example, to achieve a north-south-north arrangement or a south-north-south arrangement. Thus, in at least some embodiments, a gas switch is a cylindrical, cross-field, gas switch that includes a concentric system of magnets.

Gas switch 100 and/or gas switch 500 may be implemented in any suitable electrical distribution and/or power system, such as, for example, in any high power electrical distribution system. For example, in some embodiments, gas switch 100 and/or 500 may be implemented in parallel with one or more other switches, such as one or more other mechanical switches, as part of a hybrid electro-mechanical switching system. In other embodiments, gas switch 100 and/or 500 may be implemented as an inline switch or inline circuit breaker, such as, for example, to the exclusion of a mechanical switch.

Embodiments of the gas switch described above thus facilitate a low voltage drop (or low forward voltage drop) mode of operation, in which sputtering and/or ablation over a conduction surface of a cathode is substantially reduced, and in which waste heat generated by operation of the gas switch is also reduced. Specifically, the gas switch operates at a low forward voltage drop of less than 150 volts. To maintain a low forward voltage drop, a conducting plasma is established between an anode and a cathode and constrained, in part, to an area of concentrated sputtering (or "cathode spot"). The cathode spot is induced into circular motion over an annular path on the surface of the conduction surface, such that no single area of the conduction surface is heavily ablated or evaporated, thereby substantially increasing the lifespan of the gas switch and reducing waste heat generated by the gas switch. In addition, an ion energy of the conducting plasma is reduced when the forward voltage drop is low, resulting in reduced sputtering at the conduction surface of the cathode.

Exemplary technical effects of the gas switch described herein include, for example: (a) establishment of a low forward voltage drop within the gas switch; (b) establishment of a circumferentially traveling region of concentrated sputtering; (c) reduction of waste heat generated by the gas switch; and (d) increased lifespan of the gas switch.

Exemplary embodiments of a gas switch and related components are described above in detail. The system is not limited to the specific embodiments described herein, but rather, components of systems and/or steps of the methods may be utilized independently and separately from other components and/or steps described herein. For example, the configuration of components described herein may also be used in combination with other processes, and is not limited to practice with the systems and related methods as described herein. Rather, the exemplary embodiment can be implemented and utilized in connection with many applications where a gas switch is desired.

Although specific features of various embodiments of the present disclosure may be shown in some drawings and not in others, this is for convenience only. In accordance with the principles of the present disclosure, any feature of a drawing may be referenced and/or claimed in combination with any feature of any other drawing.

This written description uses examples to disclose the embodiments of the present disclosure, including the best mode, and also to enable any person skilled in the art to practice the disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gas switch arranged about a switch axis, the gas switch comprising:

an anode;

a cathode spaced apart from said anode, said cathode comprising a conduction surface;

a plurality of magnets arranged to generate a magnetic field, wherein a portion of the magnetic field extends parallel to a portion of the conduction surface at a radial distance from the switch axis, and wherein the magnetic field defines a closed annular path over the portion of the conduction surface at the radial distance;

a first grid positioned between said cathode and said anode, said first grid defining a grid-to-cathode gap that contains an ionizable gas; and a second grid positioned between said first grid and said anode, said second grid defining a grid-to-anode gap, said second grid arranged to receive a bias voltage to establish a conducting plasma between said anode and said cathode, wherein, in the presence of the conducting plasma, a voltage drop between said anode and said cathode is in the range of 50-150 volts, and wherein the conducting plasma forms a cathode spot that circles the annular path.

2. The gas switch of claim 1, wherein the ionizable gas comprises at least one of i) hydrogen gas, and ii) helium gas.

3. The gas switch of claim 1, wherein said cathode comprises at least one of i) gallium, ii) an alloy of gallium, iii) indium, iv) tin, and v) aluminum.

4. The gas switch of claim 1, wherein the voltage drop between said anode and said cathode is approximately 80 volts.

5. The gas switch of claim 1, wherein said first grid comprises a perforated electrically conductive surface.

6. The gas switch of claim 1, wherein said second grid comprises a perforated electrically conductive surface.

7. The gas switch of claim 1, wherein said plurality of magnets comprise at least one annular magnet arranged circumferentially about a lower surface of said cathode and a second central magnet disposed proximal the lower surface of said cathode along the switch axis.

8. The gas switch of claim 1, wherein said plurality of magnets comprise a plurality of concentrically arranged annular magnets disposed circumferentially about a lower surface of said cathode and a central magnet disposed proximal the lower surface of said cathode along the switch axis.

9. The gas switch of claim 1, wherein a magnetic field strength parallel to the annular path is in the range of 50-2,000 Gauss.

10. The gas switch of claim 1, wherein said cathode is magnetized to a field strength in the range of 100-1,000 Gauss.

11. The gas switch of claim 1, wherein the cathode spot circles the annular path at a frequency in the range of 0.1-100 kilohertz.

12. The gas switch of claim 1, wherein the conducting plasma is further established between said anode and said cathode in response to an externally applied pulse of electrical current received from a power supply.

13. The gas switch of claim 1, wherein said cathode is one of i) a planar cathode and ii) a cylindrical cathode, and wherein said anode is one of i) a planar anode and ii) a cylindrical anode.

14. The gas switch of claim 12, wherein the power supply is arranged to generate at least one of i) an oscillating sine wave and ii) an oscillating square wave, and wherein the at least one of i) the oscillating sine wave and ii) the oscillating square wave is applied to said second grid at a peak voltage over a period of time less than 20 microseconds.

15. The gas switch of claim 12, wherein the power supply is arranged to generate an output voltage which has a rate of voltage rise in the range of 0.1-250 megavolts/second.

16. The gas switch of claim 1, wherein said conduction surface comprises a smooth, featureless, surface, and wherein, in said gas switch, said cathode is not disposed proximal any conducting surfaces capable of intercepting electrical current flowing between said anode and said cathode.

17. The gas switch of claim 1, wherein said planar cathode is one of i) liquid cooled and ii) thermoelectrically cooled.

18. A gas switch arranged about a switch axis, the gas switch comprising:

an anode;

a cathode spaced apart from said anode, said cathode comprising a conduction surface;

a plurality of magnets arranged to generate a magnetic field that defines an annular path over a portion of said conduction surface at a radial distance from the switch axis; and a control grid positioned between said anode and said cathode, said control grid arranged to establish a conducting plasma between said anode and said cathode, wherein, in the presence of the conducting plasma, a voltage drop between said anode and said cathode is in the range of 50-150 volts, and wherein the conducting plasma forms a cathode spot that circles the annular path at a frequency greater than 0.1 kilohertz and less than 100 kilohertz.

19. A method for operating a gas switch, said method comprising:

establishing a magnetic field, at least a portion of which extends parallel to a portion of a conduction surface of a cathode, the magnetic field defining an annular path over the portion of the conduction surface;

establishing a conducting plasma between the cathode and an anode spaced apart from the cathode;

applying a pulsed input voltage to a control grid disposed between the anode and the cathode, wherein, in response to the application of the pulsed input voltage, a voltage drop between the anode and the cathode is in the range of 50-150 volts, and wherein the conducting plasma forms a cathode spot that circles the annular path.

* * * * *